United States Patent [19]

Fausone

[11] 4,239,037

[45] Dec. 16, 1980

[54] FACE LIFTING EQUIPMENT

[76] Inventor: David C. Fausone, 1011 N. Hilldale, Apt. 2, Beverly Hills, Calif. 90069

[21] Appl. No.: 77,109

[22] Filed: Sep. 19, 1979

[51] Int. Cl.[3] ..... A61F 5/08

[52] U.S. Cl. ..... 128/76 B

[58] Field of Search ..... 128/76 B, 76 R; 132/46 R

[56] References Cited

U.S. PATENT DOCUMENTS

| | | | |
|---|---|---|---|
| 3,575,165 | 4/1971 | Heale | 128/76 B |
| 3,695,257 | 10/1972 | Hale | 128/76 B |
| 3,736,925 | 6/1973 | Erman | 128/76 B |
| 3,776,244 | 12/1973 | Morgan | 128/76 B |

*Primary Examiner*—John D. Yasko

*Attorney, Agent, or Firm*—Ralph B. Pastoriza

[57] ABSTRACT

The face lifting equipment includes a hairpiece with comb for holding the hairpiece on top of a woman's head. A strip of material including VELCRO is secured at its central portion to the underside of the hairpiece and its top surface made accessible by bending up opposite portions or wing portions of the hairpiece. Elastic bands terminating in adhesive elements include VELCRO pads for connection to the VELCRO on the strip. The adhesive pads adhere to the woman's skin adjacent to her temples to pull upwardly on the skin and thus remove wrinkles and the like. The use of VELCRO provides an infinate number of positions for securement of the VELCRO pads so that a very fine control of the tension in the elastic members can be realized.

2 Claims, 4 Drawing Figures

FACE LIFTING EQUIPMENT

This invention relates generally to cosmetics and more particularly to improved face lifting equipment for providing the beneficial effects of a face lift without the necessity of surgery.

BACKGROUND OF THE INVENTION

Face lifts generally involve a surgical operation so that the skin adjacent the temple areas of a woman's head can be pulled upwardly thereby removing wrinkles and the like on the sides and lower neck portions in the face and neck area. Because such surgery is fairly time consuming and expensive it has been proposed in the past to provide equipment which will effect a "face lift" simulating that produced by such surgical operations but without involving any surgery.

Examples of the foregoing are shown in U.S. Pat. Nos. 3,154,071; 3,524,443; and 3,736,925. Essentially, the devices shown in these patents include adhesive elements arranged to be adhesively secured to a woman's skin adjacent to her temples. The adhesive elements in turn are connected by elastic members or lines to an appropriate central structure arranged to lie on top of the woman's head. Various different means are provided for enabling adjustment of the tension applied to the adhesive elements by the elastic supporting lines thereby lifting the skin.

Problems associated with the foregoing types of structures involve some difficulty in effecting the proper tension adjustment. Further, there is some difficulty involved in actually attaching the equipment to the woman's head. It is difficult for her to carry this operation out herself and thus the services of another person are oftentimes necessary. Finally, unless careful camouflaging of the upper portion of the equipment passing over the wearer's head is carried out, the face lifting equipment is sometimes visible, much to the chagrin of the person using the same.

BRIEF DESCRIPTION OF THE PRESENT INVENTION

With the foregoing considerations in mind, the present invention contemplates the provision of improved face lifting equipment of the type to simulate a face lifting operation without the necessity of any surgery.

More particularly, there is contemplated the provision of greatly improved equipment utilizing adhesive elements which can be manually secured to a woman's skin adjacent the temple areas and an upward tension force applied thereto by appropriate elastic lines. The arrangement is such, however, that application of the equipment is very easily carried out by the woman herself so that the services of another are not necessary. Moreover, there is a unique fastening arrangement for the adhesive elements in combination with a hairpiece overlying the top of the patient's head wherein adjustment of tension can be very easily carried out and wherein the presence of the equipment is readily camouflaged by the hairpiece in question.

In the preferred embodiment of the invention, the appropriate securing means for adhesive elements takes the form of VELCRO so that, in effect, an infinite number of positions and thus tensions can be provided to the adhesive elements thereby enabling a fine degree of tension control in the "lifting" forces. Moreover, simplified hook constructions have been provided to make it very easy for the user to substitute fresh adhesive elements when such becomes necessary.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
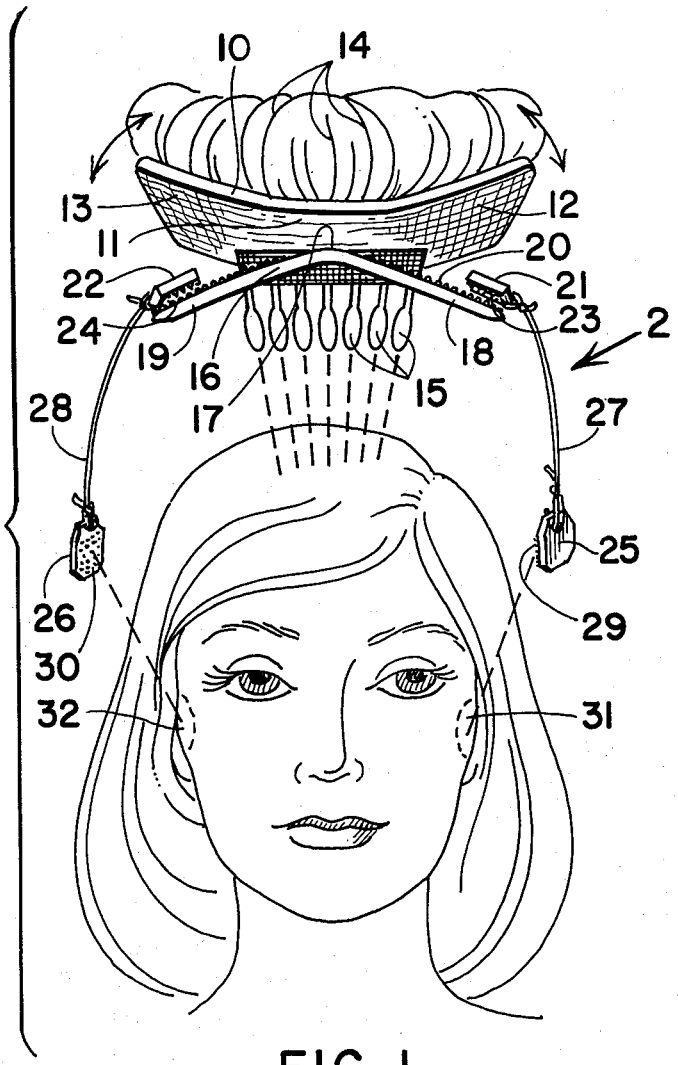
FIG. 1 is an exploded front view of the face lifting equipment of this invention preparatory to being inserted on a woman's head.

Referring first to FIG. 1, the face lifting equipment includes a hairpiece shown in the upper portion of the drawing having an elongated base 10 made up of a central portion 11 with left and right wing portions 12 and 13 extending in opposite directions. Hair designated generally by the numeral 14 is secured to the top surfaces of the central and left and right wing portions of the base 10 as shown. The base 10 is flexible to a certain extent and can be bent upwardly as indicated by the double-headed arrows in FIG. 1.

Cooperating with the base member and constituting part of the hairpiece is a comb 15 secured to the underside of the central portion 11 of the base 10. The comb teeth extend generally rearwardly as indicated in FIG. 1.

Still referring to FIG. 1, the equipment includes an elongated strip 16 underlying the base 10 and secured at its central top 17 to the central portion of the base. Strip 16 includes left and right arms 18 and 19 extending generally beneath the left and right wing portions 12 and 13 of the base 10 as shown. The wing portions themselves can be bent upwardly to expose the top surfaces of the arms. These top surfaces are covered with a securing means known in the art under the trademark of VELCRO. This VELCRO is indicated by the numeral 20.

As a matter of convenience and simplicity in the present specification and in the claims of this application, the trademark VELCRO will be utilized as the name of the securing means in applicant's preferred embodiment. By definition, VELCRO is the name of a synthetic material generally sold in ribbon or sheet form provided with complementary parts which adhere to each other when pressed together, the material being readily available to the public to be used as a fastener, closure or the like.

Cooperating with the VELCRO 20 in FIG. 1 are left and right pads 21 and 22 having VELCRO for interlocking with the VELCRO on the arms 18 and 19 in desired selected positions. The VELCRO on the pads is indicated by the numerals 23 and 24 respectively.

The face lifting equipment is completed by the provision of left and right adhesive elements 25 and 26 connecting to the pads through appropriate left and right elastic lines 27 and 28.

The adhesive elements 25 and 26 include an adhesive substance indicated at 29 and 30 on their inside surfaces. These elements are arranged to be pressed against a woman's skin areas adjacent to her temples such as indicated at 31 and 32 in FIG. 1. The hairpiece comb 15 in turn is arranged to be received in the woman's hair 33 on top of her head, the comb serving to anchor and hold in a given position the supporting strip 16.

Thus it will be understood that in affixing the equipment, the adhesive elements 25 and 26 are first pressed adjacent to the temples of the woman's face and the upper ends of the elastic lines 27 and 28 terminating in the VELCRO pads 21 and 22 are connected to the supporting strip wings 18 and 19 respectively by simply pressing the same against the VELCRO 20 on the top surface of the arms of the strip. In this respect, the wings 12 and 13 of the base 10 for the hairpiece can be manually bent upwardly to expose the VELCRO 20 on the supporting strip 16.

The hair 14 of the hairpiece will blend in with the woman's hair 33 after securement of the VELCRO pads and strip arms has been completed. It will be understood that the wings 12 and 13 are bent downwardly or simply pressed against the top of the wearer's head and appropriate camouflaging results so that the structure is not visible.

Figure 2:
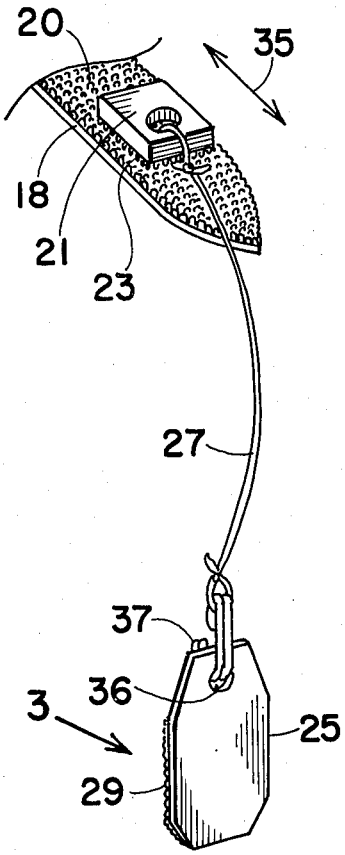
FIG. 2 is a fragmentary perspective view of a portion of the equipment looking in the direction of the arrow 2 of FIG. 1.

Referring to the enlarged perspective fragmentary view of FIG. 2, there is indicated by the double-headed arrow 35 the infinite number of effective positions of securement of the VELCRO pad 21 to the strip arm 18. Positioning the pad 21 closer to the central portion of the strip; that is, the point of attachment 17 illustrated in FIG. 1, increases the tension in the elastic line 27 whereas positioning of the pad further from the central area decreases the tension.

It will also be noted in FIG. 2 that the adhesive element contains an opening 36 for receiving a hook 37 on the end of the elastic line 27. This arrangement permits very easy manual connecting and disconnecting of the elastic line from the adhesive element so that replacement thereof can readily be carried out. A similar hook structure is provided for the adhesive element 30 described in FIG. 1.

Figure 3:
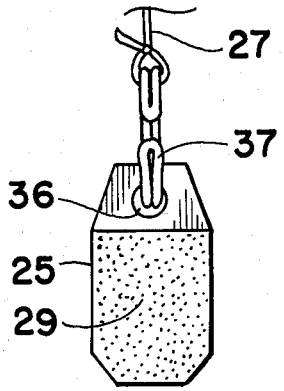
FIG. 3 is a rear view of one of the adhesive elements looking in the direction of the arrow 3 of FIG. 2; and, FIG. 4 is a side view of a woman's head on a reduced scale illustrating the equipment in operation.

In FIG. 3, it will be noted that the adhesive substance 29 for the element 25 covers a major portion of the facing area. However, the portions surrounding the opening 36 for receiving the hook 37 does not include any adhesive so that hooking and unhooking can be more easily carried out by the woman herself.

Figure 4:
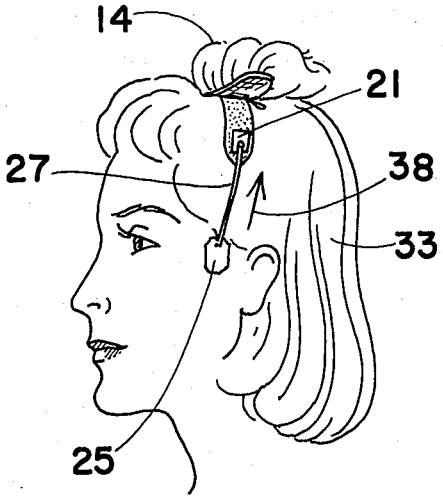

FIG. 4 illustrates in side view the securement of the adhesive element 25 to the skin area of the woman adjacent to her temple. In FIG. 4, the woman's hair 33 has been brushed back slightly to expose the adhesive element and the connecting elastic line and pad 21. It will be understood, however, that after securement has been effected, the woman's hair is brushed over to camouflage and eclipse these components. Arrow 38 in FIG. 4 indicates tension or upward force applied by the elastic line on the adhesive element 25 which upward force will stretch the woman's skin upwardly and thus remove wrinkles and the like in her face.

Several advantages result from the foregoing described face lifting equipment. First, the jowls are lifted instantly and neck wrinkles and the like thus disappear. Second, and as stated heretofore, the user can readily apply the lift to herself. The hairpiece as also described heretofore, not only camouflages the base and supporting strip, but adds more thickness to the woman's hair. The gentle uplift resulting from the tension applied to the adhesive elements will firm up the facial muscles basically functioning in the same manner as facial isometrics. The entire equipment can be applied in a total of five minutes or less.

In actual operation, it will be understood that the adhesive elements can be removed during the evening while the user is sleeping and then fresh adhesive elements can be applied in the morning to provide a lift. The hairpiece attachment including the base supporting strip may, if desired, remain on the woman's head.

A further feature and advantage of the present invention is that if a person is thinking of surgery, by using the equipment of this invention, the desired results can be simulated before the actual surgery to see if such warrants the actual surgery.

From all of the foregoing, it will thus be evident that the present invention has provided a greatly improved face lifting equipment which will simulate the results of cosmetic surgery without the necessity of any actual surgery.

I claim:

1. Face lifting equipment comprising, in combination:

(a) a hairpiece having an elongated base made up of a central portion with left and right wing portions extending in opposite directions and hair secured to the top surfaces of said central and wing portions;

(b) a comb member secured to the underside of said central portion with teeth extending generally rearwardly so that said hairpiece can be anchored on top of a woman's head to blend in with the woman's hair;

(c) an elongated supporting strip underlying said base secured at its central top to said central portion of said base and having left and right arm extending generally beneath said left and right wing portions, respectively, said wing portions being bendable upwardly to expose the top surfaces of said arms, said top surfaces being covered with VELCRO;

(d) left and right pads having VELCRO for interlocking with the VELCRO on said arms;

(e) left and right adhesive elements for adhering to said woman's skin adjacent to left and right temple areas, and (f) left and right elastic lines connecting said adhesive elements to said pads respectively, the positions of the pads on said arms being adjustable by simply lifting the pads to separate the VELCRO facings and repositioning them closer to said central portion or further from said central portion depending on whether it is desired to increase or decrease the lifting tension on said adhesive elements.

2. The subject matter of claim 1, in which said adhesive elements having openings therethrough, said elastic lines terminating in hooks movable through said openings to connect the lines to the elements whereby said elements may be easily manually removed and replaced with fresh adhesive elements.

* * * * *